US009199264B2

(12) United States Patent
Tom et al.

(10) Patent No.: US 9,199,264 B2
(45) **Date of Patent: *Dec. 1, 2015**

(54) APPARATUS FOR CREATING A WATER FORMED IMAGE

(71) Applicant: Pyrotek Special Effects, Inc., Markham (CA)

(72) Inventors: Danny Tom, Marham (CA); Douglas Adams, Markham (CA)

(73) Assignee: PYROTEK SPECIAL EFFECTS, INC., Markham, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/045,653

(22) Filed: Oct. 3, 2013

(65) Prior Publication Data

US 2014/0034746 A1 Feb. 6, 2014

Related U.S. Application Data

(63) Continuation-in-part of application No. 12/531,174, filed as application No. PCT/CA2008/000467 on Mar. 12, 2008, now Pat. No. 8,556,190.

(30) Foreign Application Priority Data

Mar. 12, 2007 (CA) ..... 2581459

(51) Int. Cl.
*B05B 17/08* (2006.01)

(52) U.S. Cl.
CPC ..... *B05B 17/085* (2013.01); *B05B 17/08* (2013.01)

(58) Field of Classification Search
CPC ..... B05B 17/08; B05B 17/085
USPC ..... 239/12, 16, 17, 18, 20, 22, 23, 211, 239/275, 279, 280, 285, 590.5, 601; 40/407
See application file for complete search history.

(56) References Cited

U.S. PATENT DOCUMENTS

| | | | | |
|---|---|---|---|---|
| 3,560,641 | A | 2/1971 | Taylor et al. | |
| 3,635,402 | A * | 1/1972 | Kawamura et al. | 239/18 |
| 3,640,463 | A * | 2/1972 | Kawamura et al. | 239/17 |
| 4,294,406 | A * | 10/1981 | Pevnick | 239/20 |
| 4,974,779 | A | 12/1990 | Araki et al. | |
| 5,067,653 | A | 11/1991 | Araki et al. | |
| 5,265,802 | A | 11/1993 | Hobbs et al. | |

(Continued)

FOREIGN PATENT DOCUMENTS

| | | | |
|---|---|---|---|
| CA | 2285728 | A1 | 4/2000 |
| EP | 0814369 | A2 | 12/1997 |

*Primary Examiner* — Ryan Reis
(74) *Attorney, Agent, or Firm* — Jansson Munger McKinley & Shape Ltd.

(57) ABSTRACT

Apparatus for pixelating falling water droplets to create a graphical image comprising an elevated water display head formed from a series of two or more modular units. Each of the series of two or more modular units has a water reservoir, a plurality of high speed solenoids located below the water reservoir, a replaceable nozzle plate having a plurality of spaced apart nozzles wherein one of said plurality of high speed solenoids is connected to each nozzle. A programmable micro-controller is provided with each of the modular units for controlling the water supply to the water reservoir and for controlling the formation of the falling water droplets through each solenoid and nozzle. The water droplets falling from said plurality of nozzles from each of the modular units forms part of the graphical image.

20 Claims, 12 Drawing Sheets

(56) References Cited

U.S. PATENT DOCUMENTS

| | | | | |
|---|---|---|---|---|
| 5,340,024 | A * | 8/1994 | Fuller et al. | 239/17 |
| 5,368,228 | A | 11/1994 | Adamson et al. | |
| 5,445,322 | A | 8/1995 | Formhals et al. | |
| 6,127,658 | A * | 10/2000 | Kohav | 219/390 |
| 6,533,190 | B1 | 3/2003 | Wang | |
| 6,557,777 | B1 * | 5/2003 | Pevnick | 239/20 |
| 6,644,768 | B2 | 11/2003 | Vega et al. | |
| 6,702,687 | B1 | 3/2004 | Henry | |
| 7,072,110 | B2 | 7/2006 | Palovuori | |
| 8,556,190 | B2 | 10/2013 | Tom et al. | |
| 2007/0125871 | A1 * | 6/2007 | Wysocki | 239/12 |

* cited by examiner

APPARATUS FOR CREATING A WATER FORMED IMAGE

CROSS REFERENCE TO RELATED APPLICATION

This application is a continuation-in-part of U.S. patent application Ser. No. 12/531,174, filed Jan. 6, 2010, now U.S. Pat. No. 8,556,190, issued Oct. 15, 2013, which is a national phase application of PCT Patent Application No. PCT/CA2008/000467 filed Mar. 12, 2008 claiming priority from Canadian Patent Application Serial No. 2,581,459 filed Mar. 12, 2007. The entire contents of each application is incorporated herein by reference.

FIELD OF THE INVENTION

This disclosure provides embodiments of a modular apparatus capable of dropping water droplets to create a graphical image.

BACKGROUND OF THE INVENTION

It is known to create water screens using a falling sheet of water or closely spaced falling water droplets on to which images are projected. Difficulties have been encountered providing water droplets that hold their shape as they fall. Consequently, high resolution images on projection water screens are not obtainable as the water droplets do not enable the projection of precise images.

In the entertainment industry, where images are required to be of a sufficient size and resolution for an audience to appreciate the image formed, there is a need for an apparatus that allows for higher installation heights and sharper consistent image quality, as well as a screen that allows viewers to differentiate between the pixilation of droplets to create an image with a high resolution that can be in varying dimensions.

In addition known apparatus for forming a water screen have a water reservoir to provide water to a series of nozzle openings in the bottom of the water reservoir. Opening and closing the nozzle openings is controlled by solenoids located above the reservoir. To create different screen layouts, the water nozzle pattern must be changed for each new configuration. This involves the need for the manufacturer of the apparatus to provide a new apparatus for each different configuration. There is a need for a system that will permit the end user to easily and quickly change the nozzle pattern for different configurations.

SUMMARY OF THE INVENTION

In one aspect, the present disclosure provides embodiments of apparatus for pixelating falling water droplets to create a graphical image. The apparatus comprises an elevated water display head formed from a series of two or more modular units. Each of the series of two or more modular units has a water reservoir, a plurality of high speed solenoids located below the water reservoir, a replaceable nozzle plate having a plurality of spaced apart nozzles wherein one of said plurality of high speed solenoids is connected to each nozzle. A programmable micro-controller is provided with each of the modular units for controlling the water supply to the water reservoir and for controlling the formation of the falling water droplets through each solenoid and nozzle, whereby water droplets falling from said plurality of nozzles from each of the modular units forms part of the graphical image that retains its shape as it falls. A master programmable micro-controller is provided to synchronize the operation of each of the series of two or more modular units.

In another embodiment, the disclosure provides an apparatus for pixelating falling water droplets to create a graphical image comprising a water management system for providing, controlling and maintaining a closed-loop pressurized water supply, an elevated water display head formed from a series of two or more modular units and each modular unit having a plurality of spaced apart nozzles arranged on a replaceable nozzle plate in a manner to provide the intended display, each of said nozzles having a water inlet and a water outlet, and a high speed solenoid for each nozzle and a control means for controlling the water supply and for controlling the formation of the falling water droplets through each solenoid and nozzle, wherein a water reservoir is provided above the solenoids and the water inlets for said nozzles so that water pressure to the nozzles is maintained by gravity, and the solenoids are connected to said nozzles to control the speed at which water exits the nozzles and whereby water droplets falling from said plurality of nozzles form a graphical image that retains its shape as it falls.

In a further aspect the present disclosure provides a method for pixelating falling water droplets to create a graphical image comprising providing an elevated water display head formed from a series of two or more modular units each modular unit having a plurality of spaced apart nozzles arranged on a replaceable nozzle plate in a manner to provide the intended display. Each of the nozzles has a water inlet and a water outlet. A high speed solenoid is provided for each nozzle and a control means is provided for controlling the water supply and for controlling the formation of the falling water droplets through each solenoid and nozzle. A water reservoir is provided with each modular unit and is located above the solenoids and the water inlets for said nozzles so that water pressure to the nozzles is maintained by gravity. The solenoids are connected to said nozzles to control the speed at which water exits the nozzles and whereby water droplets falling from said plurality of nozzles form a graphical image that retains its shape as it falls. A micro-controller is provided for each modular unit for a) taking incoming display data from a streaming data source and generating, by control of the solenoids, a water pixilated display of an assigned portion of the image and b) regulating the water entering the reservoir of each of the series of two or more modular units and monitoring sensors in the reservoirs to maintain optimum capacity.

Further features of the invention will be described or will become apparent in the course of the following detailed description.

BRIEF DESCRIPTION OF THE DRAWINGS

In order that the disclosure may be more clearly understood, the embodiments will now be described in detail by way of example, with reference to the accompanying drawings, in which.

Similar reference numbers are used in different figures to denote similar components.

DETAILED DESCRIPTION OF THE INVENTION

Figure 1:
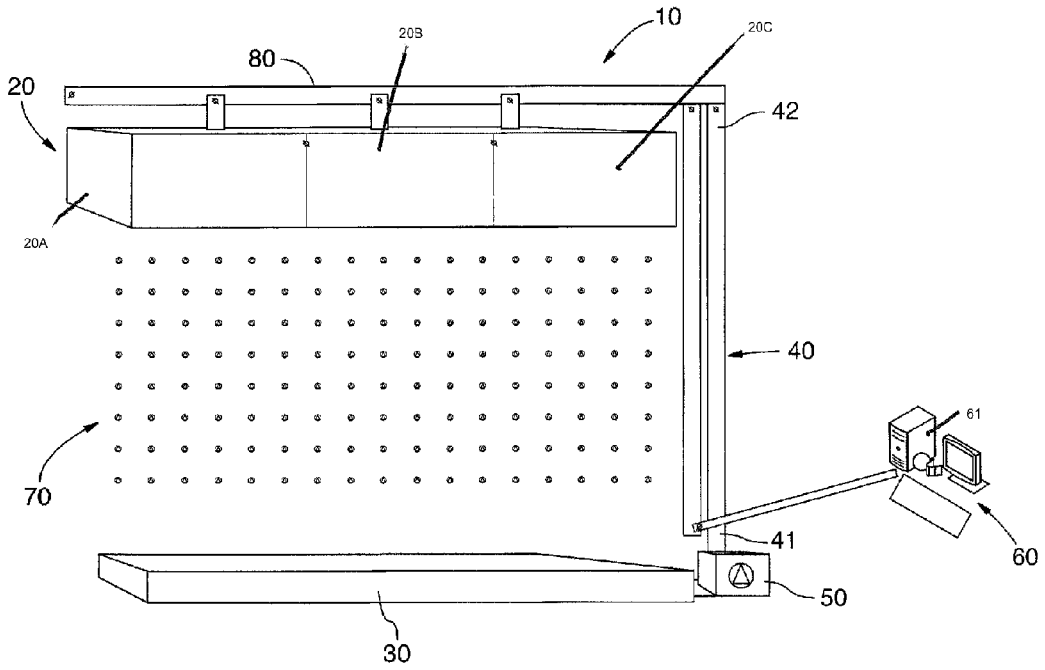
FIG. 1 is a schematic diagram of one embodiment of the apparatus for pixelating falling water droplets to create a graphical image according to the present invention having a water management system and an elevated water display head formed of three modular units.
Figure 2:
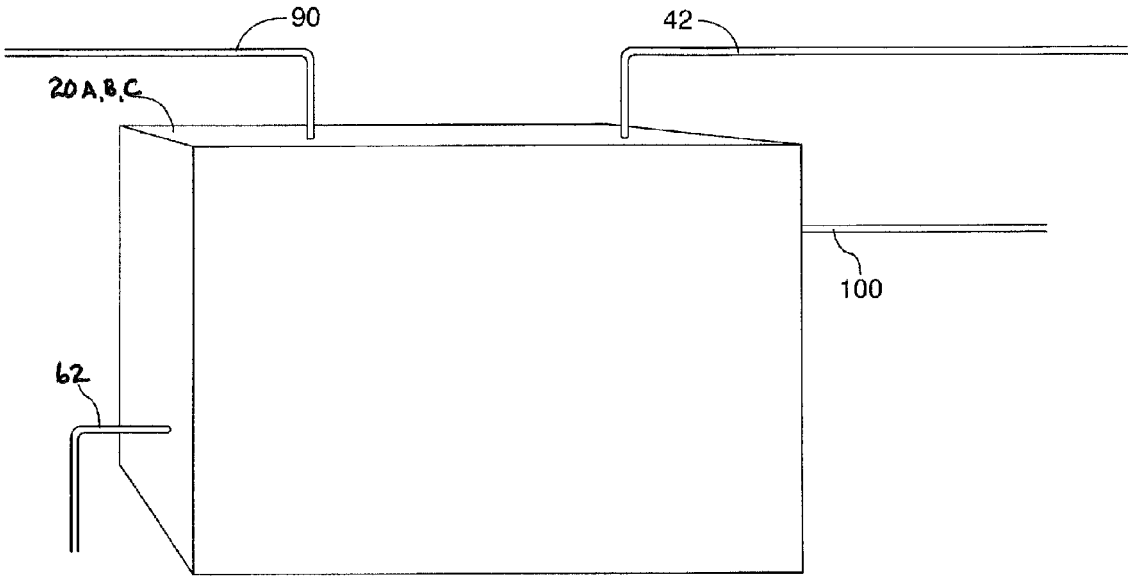
FIG. 2 is a schematic illustration of one of the modular units of the elevated water display head of FIG. 1 shown with the inlet into the water reservoir.
Figure 3:
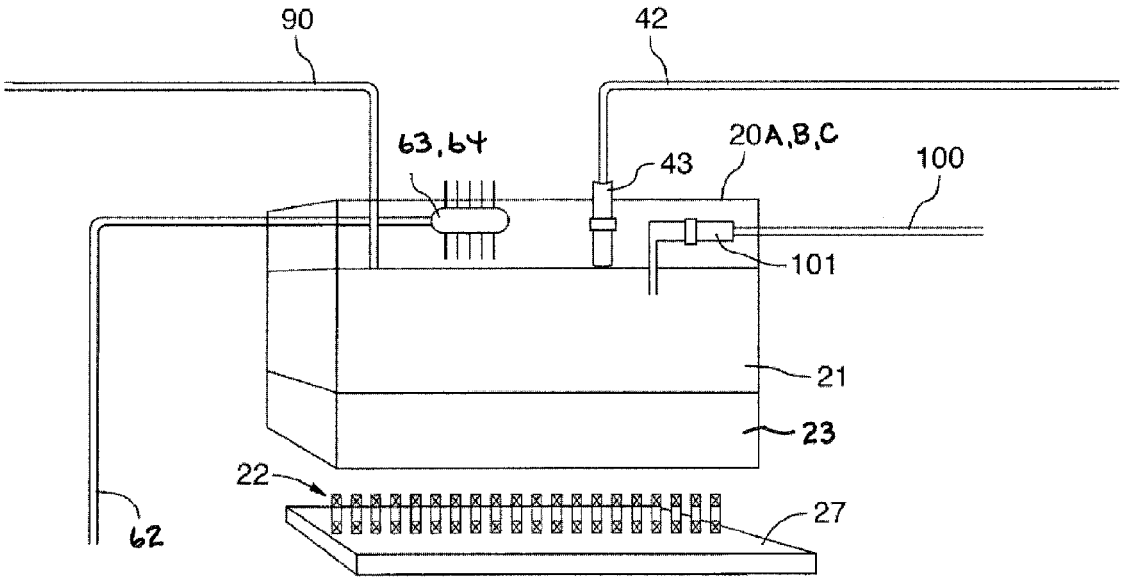
FIG. 3 is a schematic diagram of one embodiment of some of the components within the modular unit of the elevated water display head of FIG. 2 with a nozzle plate unattached.

With reference to the FIGS. 1 to 3, the disclosure provides apparatus, generally indicated at 10, for pixelating falling water droplets 70 to create a graphical image. The apparatus comprises an elevated water display head, generally indicated at 20, formed from a series of two or more modular units. In FIG. 1 three modular units 20A, 20B and 20C are illustrated although a fewer or larger number of units can be utilized depending on the width of the desired display. The modular units for example, can be provided in two foot lengths, which are interconnected end to end to form lengths up to forty eight feet. Lengths of twelve, twenty four, and thirty six feet are common in many applications. In certain embodiments, there is a clearance of 12 feet on both sides of the graphical water screen. The elevated water display head 20 in the embodiment illustrated in FIG. 1 is suspended off a trussing system 80.

Figure 4:
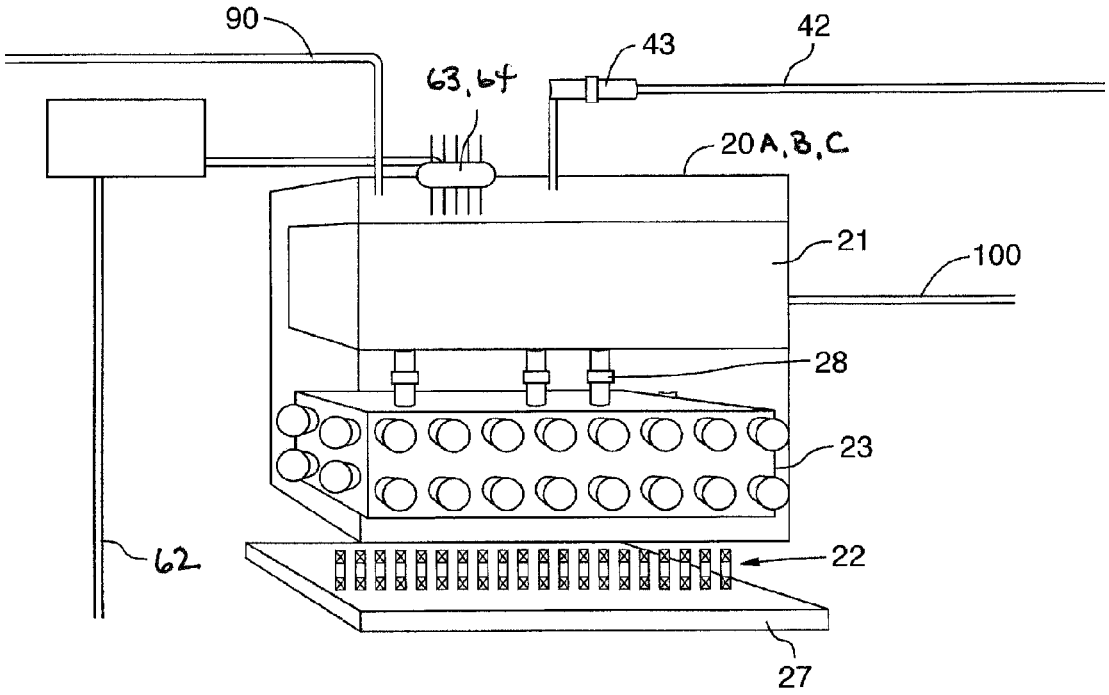
FIG. 4 is another schematic diagram with further detail of the components within the modular unit of the elevated water display head of FIG. 2 with a nozzle plate unattached.

As best shown in FIGS. 3 and 4, each of the series of modular units, 20A-C, has a water reservoir 21, a plurality of high speed solenoids 23 located below the water reservoir 21, a replaceable nozzle plate 27 having a plurality of spaced apart nozzles 22 wherein one of said plurality of high speed solenoids 23 is connected to each nozzle 22. The solenoids 23 control the flow of water through the nozzles 22 between an on position and an off position, as shown more generally in FIG. 5, as described below.

A control means, generally indicated at 60, see FIG. 1, includes a programmable micro-controller 63, 64 provided with each of the modular units for controlling the water supply to the water reservoir and for controlling the formation of the falling water droplets through each solenoid and nozzle, whereby water droplets falling from said plurality of nozzles from each of the modular units forms part of the graphical image that retains its shape as it falls. The control means further includes a master programmable micro-controller 61 (shown in FIGS. 1 and 6) to synchronize the operation of each of the series of two or more modular units.

A feature of the embodiment of FIGS. 3 and 4 is the use of a vacuum source with the apparatus 10 to apply a negative pressure to inside of each of the modular units 20A-C to prevent water from dripping from nozzles 22 when the operating solenoid 23 is intended to be closed. When the system is not in use and the solenoids 23 are directing the nozzles 22 not to dispense water, the anti-drip negative pressure vacuum system, as shown by the vacuum line 90 in FIGS. 3 and 4 is connected to each of the modular units of the elevated water display head 20. The vacuum line 90 can be activated to prevent water from being inadvertently released from the nozzles 22.

The apparatus in the embodiment illustrated in FIG. 1 has a water basin 30 that is adapted to receive water droplets dispensed from the nozzles 22. The water collected in basin 30 is recycled back to the elevated water head 20 by water conduit 40 which has one end 41 connected to the water basin and a second end 42 remote from the water basin 30. As shown in FIG. 4, the second end 42 of water conduit 40 connects through valve 43 to the water reservoir(s) 21 within each of the modular units 20A-C in the elevated water display head 20. Through the action of the pump means 50, the water can circulate from the water basin 30 into the first end 41 of the water conduit 40, up towards the second end 42 of the water conduit 40, and out into the water reservoir 21.

As shown in FIG. 4 elevated water display head valves 28 may be provided between the water reservoir 21 and the solenoids 23 to control the flow of water on or off.

Sufficient horsepower must be present in the pump means 50 so as to recirculate water within the apparatus to maintain adequate flow dynamics. The storage of water in water basin 30 and water reservoir(s) 21 should enable a constant supply of water across the solenoids 23 in the elevated water display head 20. Approximately a 3:1 ratio water between the water basin 30 and the water reservoir(s) 21 in the elevated water display head 20 has been found to be adequate. About 3 gallons of water or 4 to 6 inches of column pressure should be present in the water reservoir(s) 21 for a consistent water image to be formed when the water is dropped from the nozzles 22.

Figure 6:
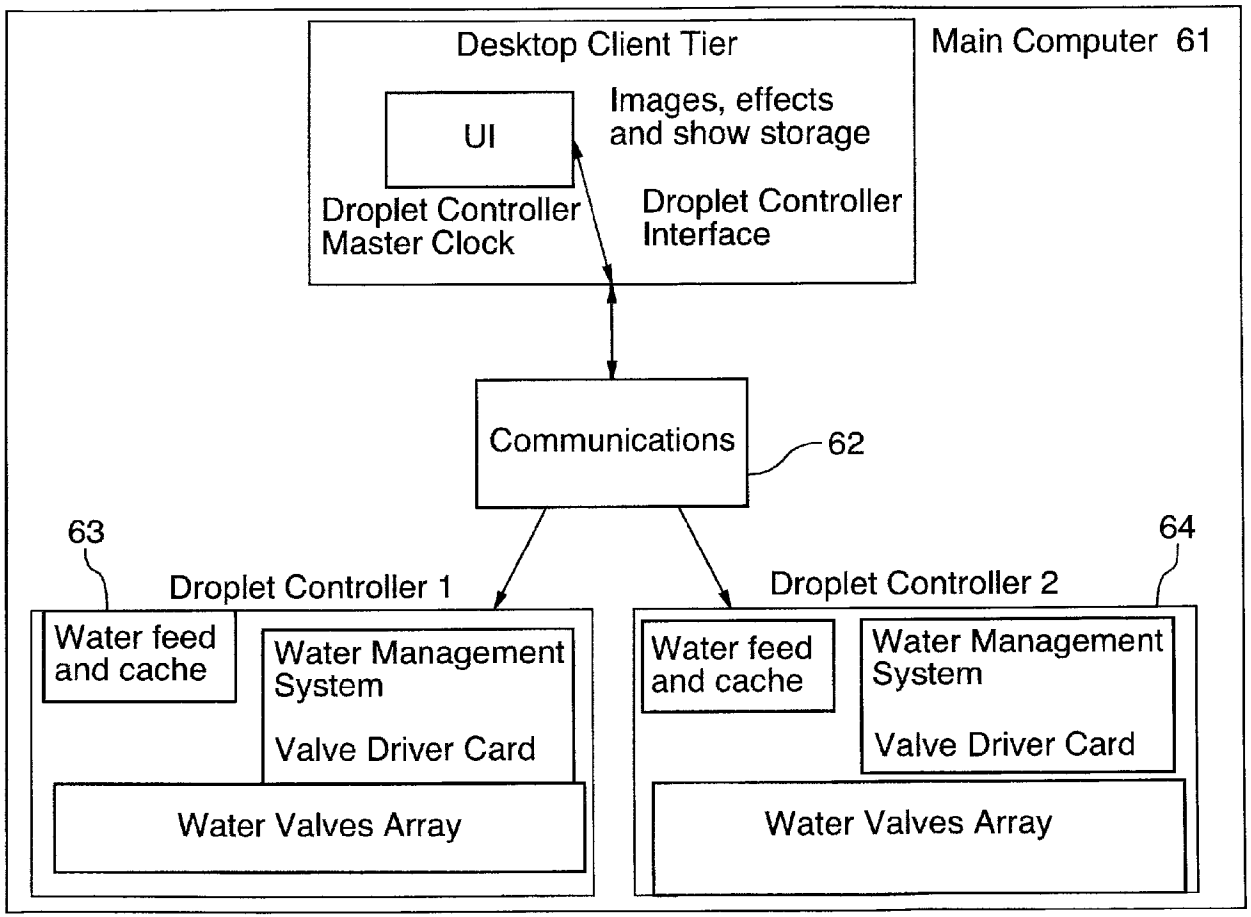
FIG. 6 is a block diagram of the control means for the apparatus of FIG. 1.

In the embodiment illustrated in FIG. 1 there is a master programmable micro-controller 61 that communicates with programmable micro-controllers for controlling the water supply to the water reservoirs 21 and for controlling the formation of the falling water droplets through each nozzle 23. In FIG. 6, a block diagram of the operation of the of the control means 60 is shown. The master programmable micro-controller (main computer) 61 communicates by communication means 62 to a plurality of programmable micro-controllers (droplet controllers) one of which is associated with each modular unit that forms the elevated water head 20. In FIG. 6 two programmable micro-controllers (droplet controllers) 63, 64 are shown one of which is associated with a modular unit for an elevated display head. The programmable micro-controllers (droplet controllers) 63, 64 are in communication a sensor that monitors water levels in the water reservoirs 21 and control the operation of the solenoids 23, so that water dropped from the plurality of spaced apart nozzles 22 in the on position forms a pixelated image of water droplets 70.

The control means 60 provides an automated mechanism for translating common graphics files into water displayable droplet images. The control means 60 has a mechanism to allow users, particularly those in the events and/or lighting field, to trigger water graphical effects or program complete water graphical shows through a computer or console applications thereby allowing for wider scale adaptation of the graphical water screen system.

The size of the water basin 30 will depend on the splashing distance of water at the base of the apparatus.

Figure 5:
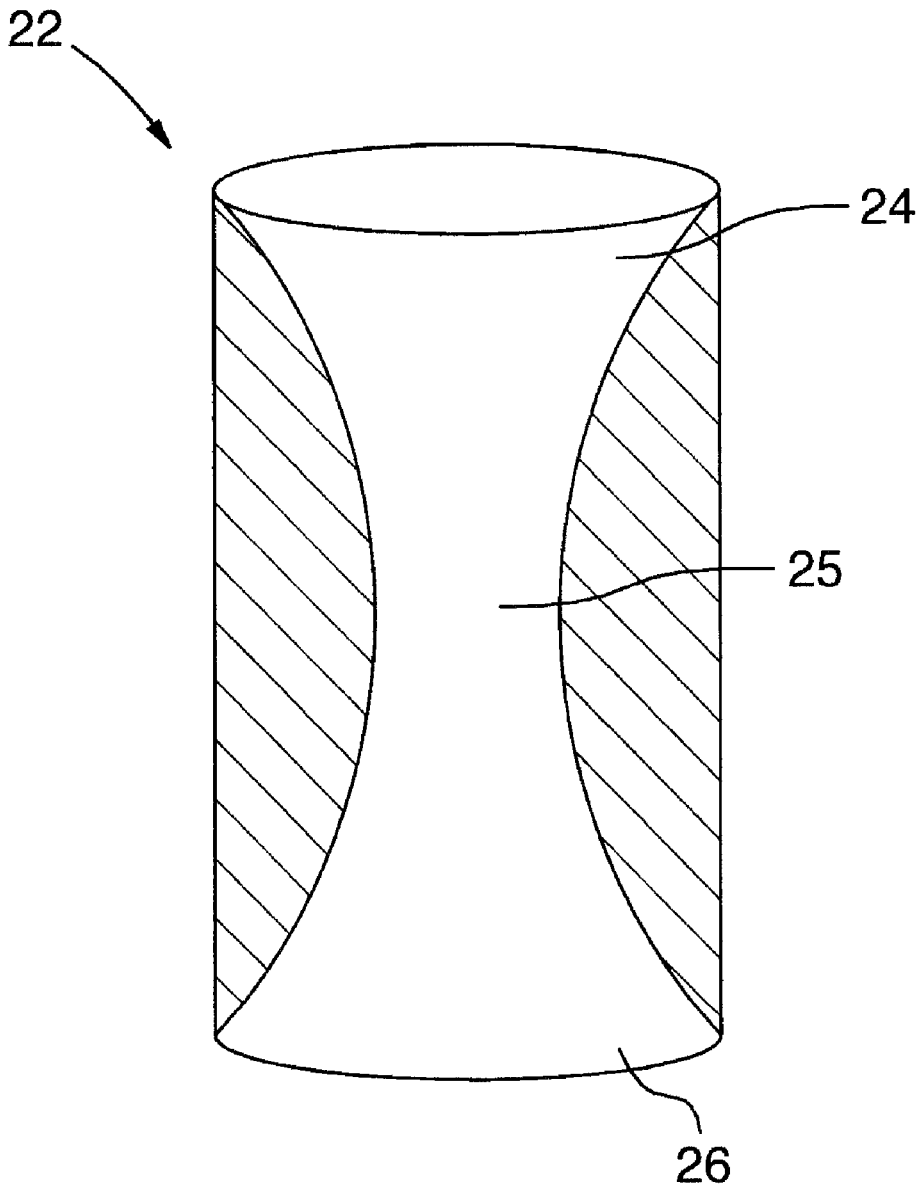
FIG. 5 is a partial perspective view of a nozzle used in the elevated water display head of FIG. 1 shown with an hourglass shaped passageway.

As shown in FIG. 5, each nozzle 22 has an inlet orifice 24, a hourglass shaped passageway 25 and an outlet orifice 26, where the hourglass shaped passageway 25 has a narrower diameter in the mid-section as compared to the inlet 24 and outlet orifices 26. When dispensing water through the nozzles, the droplets will be shaped as a tear drop for the greatest period of time in order to provide a consistent pixelated image across the water screen. By shaping the passageway 25 as an hourglass, the water droplets dispensed from the outlet orifice 26 can retain an hourglass shape for as long as possible, including lengths of 10 feet or more, and even to heights of 30 feet. Also, by shaping the passageway 25 as an hourglass, prevents the clumping of water that results from hydrophilic forces that attract water molecules together. Waxes, such as Teflon® and Caranuba wax, can be used on the inner and outer surfaces of the passageway 25 to further prevent the hydrophilic forces of the water. Nozzles 22 that are used in precise medical instrumentation may be used in conjunction with high speed solenoids 23 to produce a high resolution pixelated image on the water screen.

The nozzles 22 are individually controlled and are high speed. The nozzles 22 are spaced apart from one another, such as being spaced 0.4 inches apart. As noted above, programmable micro-controllers 63, 64 (see FIG. 6) control the operation of the solenoids 23 which in turn control the opening and closing of the nozzles 22 in a rapid fashion, thereby producing scrolling water-formed images on the water screen when water is dispensed from the nozzles 22. The nozzles 22 can be opened and closed by the solenoids 23 as fast as 200 times per second. This modulation of dispensing water droplets forms a continuous matrix of horizontal water dots that is analogous to the operation of a dot matrix printer.

The path length from each solenoid to the nozzle may be the same but if different, timing of the operation of the solenoids 23 is controlled by the programmable micro-controllers 63, 64 to accommodate different path lengths.

Figure 8:
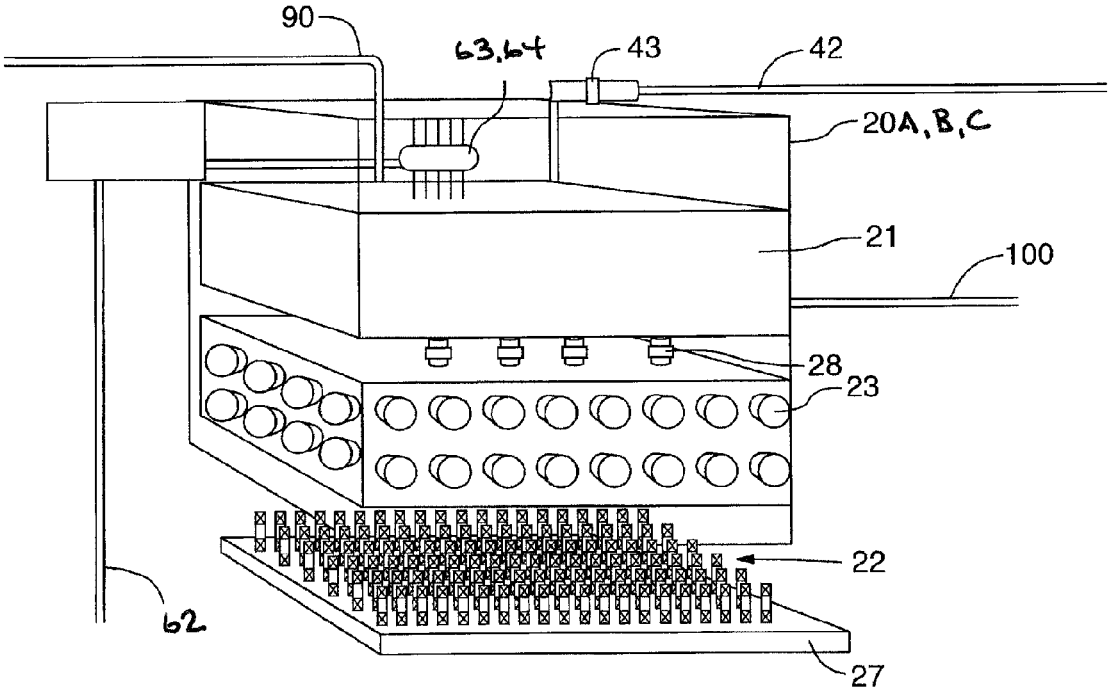
FIG. 8 is a schematic diagram of another embodiment of components within a modular unit of the elevated water display head that may be used to create a three-dimensional image.

As seen in FIG. 8, the nozzles 22 can be oriented in different rows on the nozzle plate 27 so as to allow for the formation of three-dimensional images. The solenoids 23 in this configuration may need to be arranged in a plurality of rows and be offset in relation to the row below.

Using the present invention, graphical file images can also be translated to a form that is projectable on a water screen as well as the creation of graphical images from the falling water. An algorithm which takes common images, including .jpg, .gif, .bmp and .png files, may be used in conjunction with the control means 60. For example, an algorithm may take multi-coloured graphics files with various pixel formats and translate them to homogeneous pixel-formatted monochrome file formats displayable as water graphical images through the control means 60.

Similar to broadcasting technology, there is a requirement to synchronize the pixilated water images to other equipment like video cameras, lighting equipment and other application software. In certain embodiments, such as some commercial applications, the repeatability factor is important and apparatus is required to synchronize pressurized water graphical images with a time source. As part of an algorithm, the height of fall of water and the terminal velocity of water may be two aspects that are taken into account and processed through the control means 60.

For example where there is a water free fall rate of 1 second for a 30 foot drop and a response time of 5 milliseconds for electronic solenoid valves, one can expect 200 cycles from each valve per second which would provide a vertical resolution of about 200 pixels.

The resolution of the water screen is also dependent on the width of the water screen. A 12 ft water screen would, in theory, provide a horizontal resolution of 360 pixels. As with video graphics technology, the wider or larger the display surface, the more intense the processor power requirements will be needed to maintain visual integrity and functionality. For larger graphical water screens, the challenges are similar. The control means 60 in the embodiments disclosed provides a parallel processing and parallel control technique applied to the specific technology requirements of a graphical water screen.

Parallel processing and solenoid control are present either separately or individually to provide extra-wide, even and consistent water displays. Multiple central processing units (CPUs) running over an Ethernet from serial to parallel to serial may be used for each group of solenoids 23.

Various effects are possible through the use of the present embodiments. Practically any image, including those that can be scanned using a flatbed scanner, can be converted for display using the water screen. In certain embodiments, the main computer 61 will convert the color information into a monochrome image. Images can be queued for back to back display.

Text messages are possible with a variety of fonts. The width of the messages may depend on font sizes and required legibility.

Through the control means 60, various water effects may also be possible, including tornado, barber effects and slotted cylinders.

The present invention may be controlled by software, including Windows XP Operating System and the Control program is a user-friendly graphical interface. The user can use the software to design, create and save complete synchronized shows on the system. The present invention is capable of interfacing various codes, including to SMPTE or MIDI time codes, and can also interface to lighting consoles, including DMX-compatible lighting consoles, which allows users to allow lighting designers use the apparatus 10.

Figure 7:
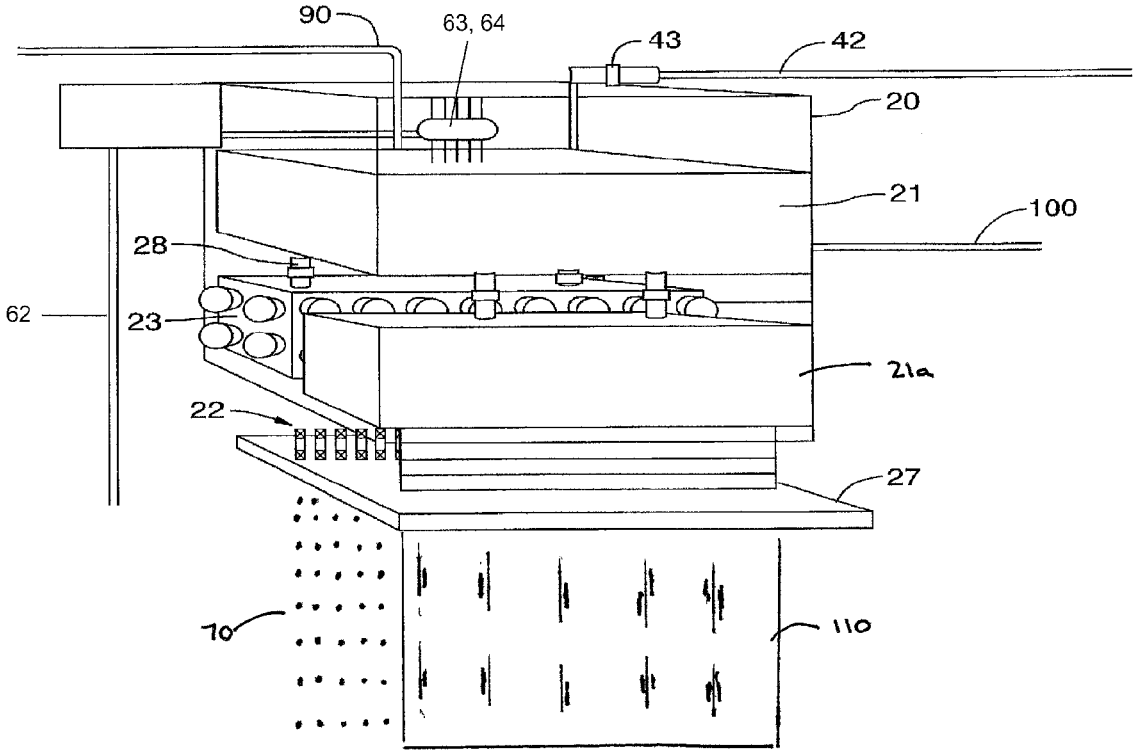
FIG. 7 is a schematic diagram of another embodiment of a modular unit of an elevated water display head with the falling sheet of water.

This disclosure further provides embodiments utilizing a dual-head system, as shown in FIG. 7, having a falling sheet of water 110 at the rear and a graphical water screen 70 in the front which can allow users to either superimpose images or have the flexibility of applying one form of projection screen or another in a given show. The falling sheet of water 110 is sourced by a constant flow to the second water reservoir 21*a* in parallel to the water reservoir 21.

Closed-loop and open loop water systems may be used with the present invention. In certain embodiments, a water supply of 90 gallons is required to fill the closed loop water re-circulation system and about 5 gallons of distilled water per day needs to be injected into the system to account for evaporation.

Certain embodiments of the present system may use a water feed system that controls and maintain a closed-loop pressurized water circulation system across the apparatus 10 that is coupled to an open system (using main city water or similar). By coupling the apparatus to a water feed system, near-instantaneous corrections of the "desired" conditions of the closed-loop water system can be made.

An outlet with an overflow valve may also be attached to the water reservoir 21 as a safety feature.

A power source is needed to operate the apparatus. For instance, certain embodiments of the present invention can be powered using a single phase 120-205 VAC power source with the apparatus requiring 2400 Watts of power.

The present embodiments have an operating temperature range of about +10 to +50 degrees Celsius.

The present invention also comprises a method for pixelating falling water droplets to create a graphical image. The water management system provides, controls and maintains a closed-loop pressurized water supply, the elevated water display head 20 has a plurality of spaced apart nozzles 22 in one or more rows and a high speed solenoid 23 for each nozzle 22 and a control means 60 for controlling the water supply and for controlling the formation of the falling water droplets through each solenoid 23 and nozzle 22. The control means 60 controls the formation of water droplets falling from each of said plurality of nozzles to form a graphical image that retains its shape as it falls. The control means 60 includes a master programmable micro-controller (main computer) 61 that communicates by communication means 62 to a plurality of programmable micro-controllers (droplet controllers) 63, 64 one of which is associated with each modular unit that forms the elevated water head. The micro-controller 63, 64 is responsible for a) taking incoming display data from a streaming data source 61 and generating a water pixilated display of its assigned portion of the image, b) regulating the water entering the reservoir 21 and monitoring sensors in the reservoir to maintain optimum capacity, and c) housekeeping functions to maintain overall functionality.

Figure 9:
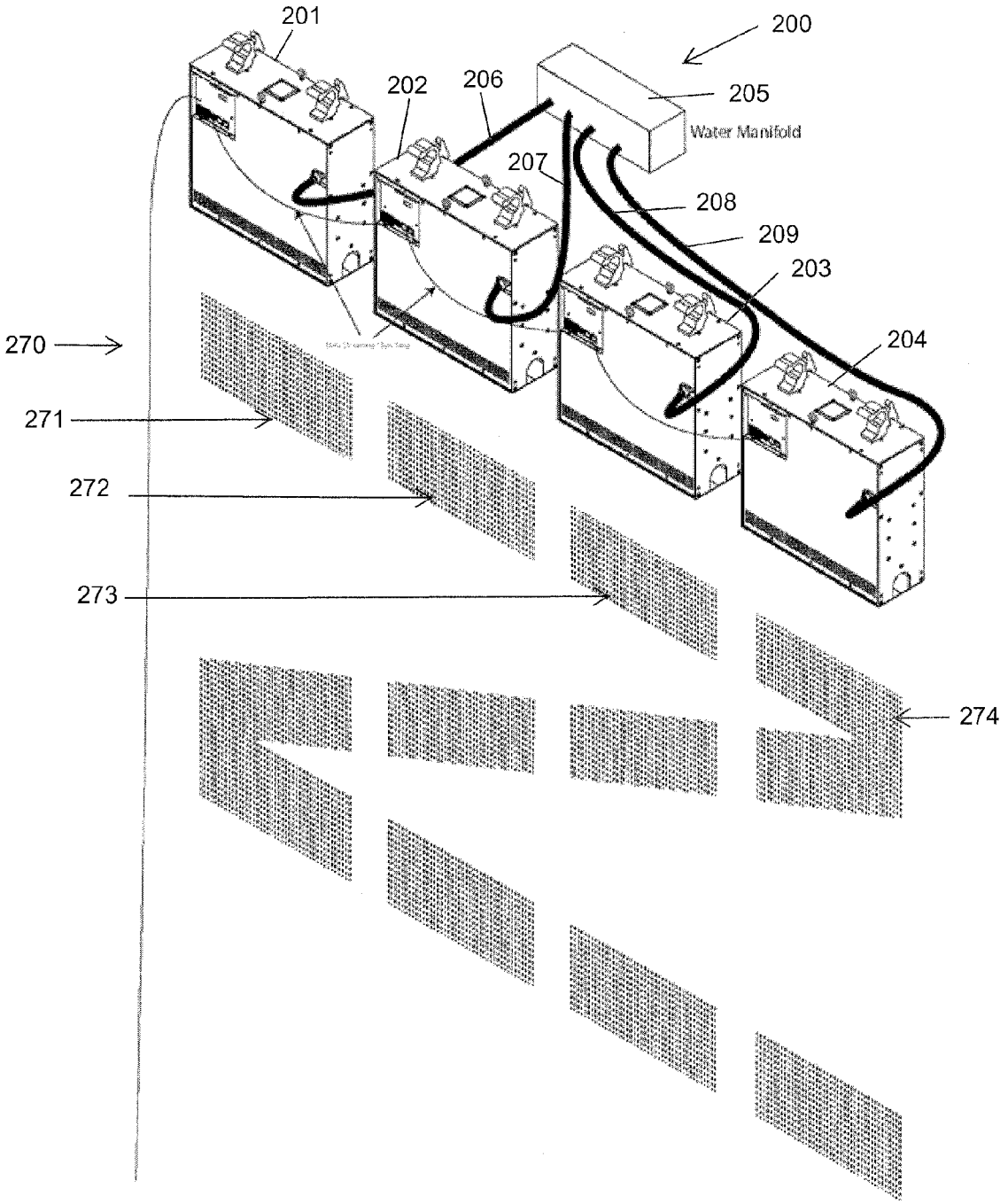
FIG. 9 is a schematic diagram of another embodiment of an elevated water display head formed from a series of modular units.

FIG. 9 illustrates schematically another embodiment of an elevated water display head, generally indicated at 200 formed from a series of modular units 201, 202, 203 and 204 connected electrically in series and configured to drop a small part 271, 272, 273, 274 of a whole image 270. The modular units are connected to a water manifold 205 linked to each of the units 201-204 by tubing 206,207, 208, 209.

Figure 10:
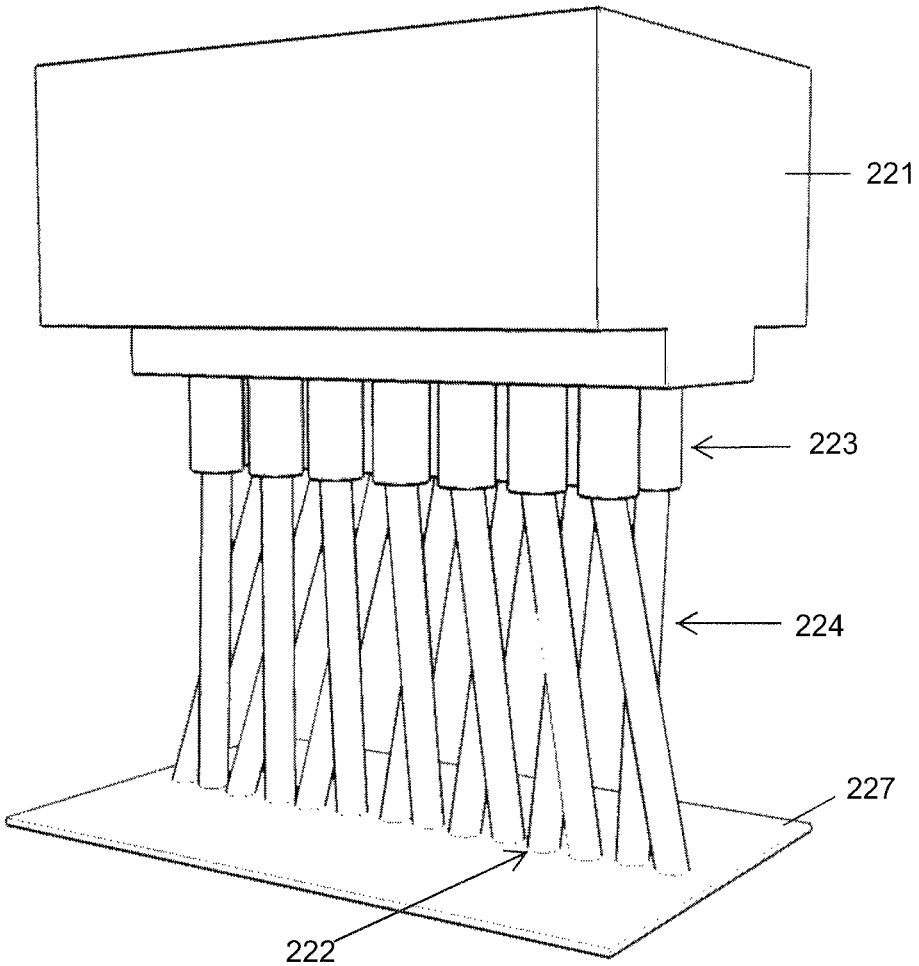
FIG. 10 is a schematic diagram of one embodiment of the water reservoir, solenoids and replaceable nozzle plate for one of the modular units of the elevated water display head of FIG. 9.

As shown in FIG. 10, within each modular unit 201, 202, 203, 204 is a water reservoir 221, a plurality of high speed solenoids 223 located below the water reservoir 221, a replaceable nozzle plate 227 having a plurality of spaced apart nozzles 222 wherein one of said plurality of high speed solenoids 223 is connected to each nozzle 222. The solenoids 223 control the flow of water through the nozzles 222 between an on position and an off position, as described above in connection with the other described embodiments.

Each modular apparatus has a programmable micro-controller and sensors associated with the water reservoir 221.

The micro-controller is responsible for a) taking incoming display data from a streaming data source and generating a water pixilated display of its assigned portion of the image, b) regulating the water entering the reservoir 221 and monitoring the sensors in the reservoir to maintain optimum capacity, and c) housekeeping functions to maintain overall functionality.

Each micro-controller for each modular unit 201, 202, 203, 204 is a self-managed stand-alone slave unit under the control of a master control system. The master control system synchronizes all the modular unit 201, 202, 203, 204 within its control domain and insures modular units 201, 202, 203, 204 are each dropping the section of water images it is assigned to drop.

The water reservoir 221 in each modular unit 201, 202, 203, 204 maintains an adequate supply of water for dropping images. The solenoids 223 attached under the reservoir 221 control the flow of water to the tubes 224 leading to the nozzles 222 on the replaceable nozzle plate 227. The solenoids 223 are under the control of the micro-controller. It switches the solenoids at high speeds—turning on and off water programmatically.

Pixelated water traverses the rubber/plastic connection tubes 224 to the nozzle plate 227. The placement method of the reservoir 221 above the solenoids 223 and having the outputs from the solenoids 223 tubed to an interchangeable water nozzle plate 227 is a feature of the embodiment disclosed.

Figure 11:
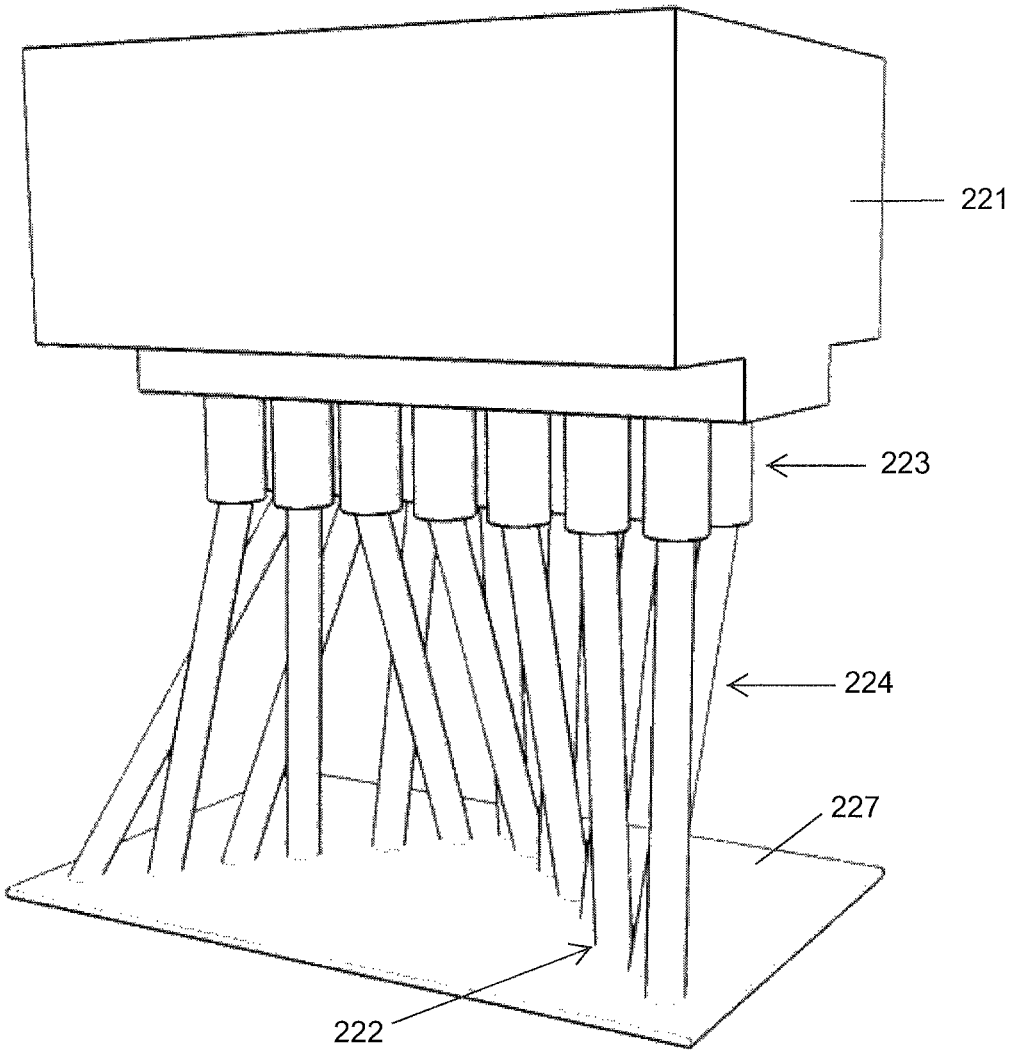
FIG. 11 is a schematic diagram of the water reservoir, solenoids of FIG. 10 with a replaceable nozzle plate having a different nozzle configuration.
Figure 12:
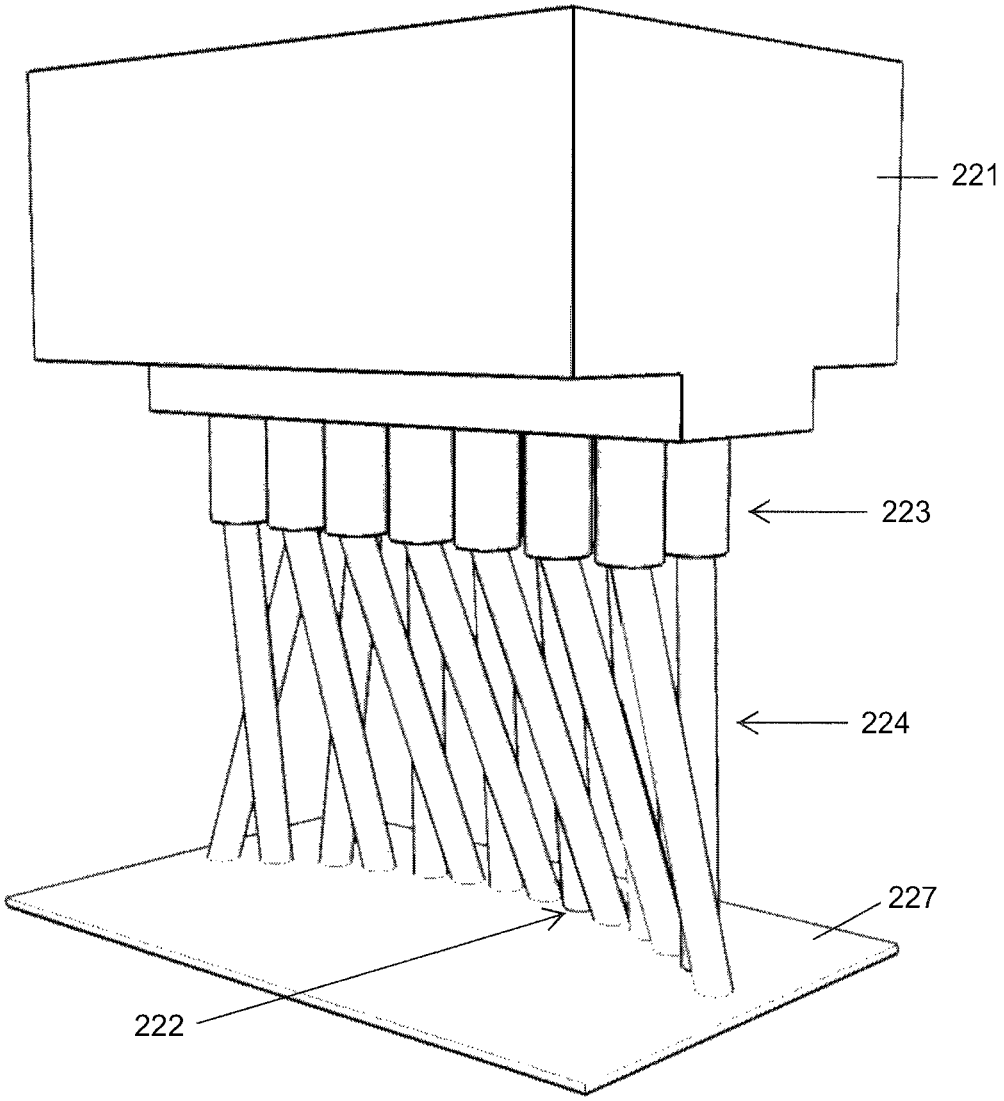
FIG. 12 is a schematic diagram of the water reservoir, solenoids of FIG. 10 with a replaceable nozzle plate having a different nozzle configuration.

FIGS. 10, 11 and 12 illustrating three of the many possible water drop patterns that can put together post-manufacturing or at the install site. These configurations are possible by simply changing the replaceable nozzle plate 227. The result of having the water reservoir 221 above the solenoids 223 and having the outputs of solenoids 223 tubed to a patterned replaceable nozzle plate 227 creates flexibility. With different sets of patterned plates, the end user (not the manufacturer) can easily assemble water screens that are straight, rectangular, circular (with a variety of diameters) or any other custom configuration.

The size of the apparatus 200 is one of the considerations in providing the functional requirements for modularity and the concept of the interchangeable water nozzle plate. The size that typically matters most is the length of the array of water nozzles used to create images. If the module array is too short, the amount of modules required to implement a fairly small screen would not make it economically or logistically feasible. If the module array is too long, it would make it harder to implement circular configurations—it may look more like a series of lines rather than something circular or the size of the apparatus would be too large.

To accommodate different screen layouts, the water nozzle pattern of each modular apparatus 200 will be changed for each new configuration. This is especially true for circular screens. Depending on the radius of the screen, the nozzle pattern must follow the curvature of the outer circumference.

The embodiments disclosed generate a multitude of water nozzle patterns fairly quickly to react to market or project-related requirements. To satisfy this criteria, the apparatus 200 employs an interchangeable nozzle plate 227 for each of the modular units 201-204. The nozzle plates 227 may be made with different water nozzle patterns. Some will be standard linear patterns or circular patterns with fixed radius curvatures. Others will be customized as required to fit individual project requirements.

Connection of the water nozzles 222 on the plate 227 to the solenoids 223 uses flexible tubes 224. The tubing should be flexible such as rubber or plastic and long enough to accommodate the various connection requirements of the different plates.

Having illustrated and described preferred embodiments and certain possible modifications thereto, it should be apparent to those of ordinary skill in the art that the invention permits of further modification in arrangement and detail and is not restricted to the specific apparatus illustrated.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed is:

1. An apparatus for pixelating falling water droplets to create a graphical image, the apparatus comprising an elevated water display head formed from a series of two or more modular units, each of the series of two or more modular units has a water reservoir, a plurality of high speed solenoids located below the water reservoir, a first replaceable nozzle plate having a plurality of spaced apart nozzles arranged on the replaceable nozzle plate in a manner to provide a first intended display and each of said nozzles having a water inlet and a water outlet, wherein one of said plurality of high speed solenoids is connected to each nozzle, wherein the water reservoir is provided above the solenoids and the water inlets for said nozzles so that water pressure to the nozzles is maintained by gravity and wherein a programmable micro-controller is provided with each of the modular units for controlling the water supply to the water reservoir and for controlling the formation of the falling water droplets through each solenoid and nozzle, whereby water droplets falling from said plurality of nozzles from each of the modular units forms part of the graphical image and wherein a second replaceable nozzle plate having a plurality of spaced apart nozzles arranged on the second replaceable nozzle plate in a manner to provide a second intended display may be interchanged into the elevated water display head for the first replaceable nozzle place in order to provide a different display.

2. The apparatus of claim 1 wherein a master programmable micro-controller is provided to synchronize the operation of each of the series of two or more modular units.

3. The apparatus of claim 1 wherein a vacuum line is connected to the water reservoir to prevent water leaking through the solenoids and nozzles when the water reservoir is placed under negative pressure.

4. The apparatus of claim 1 wherein the path length from each solenoid to the nozzle is the same.

5. The apparatus of claim 1 wherein the timing is controlled to accommodate different path lengths from each solenoid to the nozzle.

6. The apparatus of claim 1 wherein the water droplets fall from heights of 10 feet or more.

7. An apparatus for pixelating falling water droplets to create a graphical image comprising a water management system for providing, controlling and maintaining a pressurized water supply, an elevated water display head formed from a series of two or more modular units and each modular unit having a plurality of spaced apart nozzles arranged on a first replaceable nozzle plate in a manner to provide the intended display, each of said nozzles having a water inlet and a water outlet, and a high speed solenoid for each nozzle and a control means for controlling the water supply and for controlling the formation of the falling water droplets through each solenoid and nozzle, wherein a water reservoir is provided above the solenoids and the water inlets for said nozzles so that water pressure to the nozzles is maintained by gravity, and the solenoids are connected to said nozzles to control the speed at which water exits the nozzles and whereby water droplets falling from said plurality of nozzles from each of the modular units forms part of the graphical image and wherein a second replaceable nozzle plate having a plurality of spaced apart nozzles arranged on the second replaceable nozzle plate in a manner to provide a second intended display may be interchanged into the elevated water display head for the first replaceable nozzle plate in order to provide a different display.

8. The apparatus of claim 7 wherein a vacuum line is connected to the water reservoir to prevent water leaking through the solenoids and nozzles when the water reservoir is placed under negative pressure.

9. The apparatus of claim 7 wherein the water management system has a catch basin for collecting the falling water droplets after falling, a water conduit between said catch basin and the inlet to the water reservoirs within the series of two or more modular units of said elevated water display head and pump means to circulate the water from the catch basin to the water reservoirs through the water conduit.

10. The apparatus of claim 7 wherein the control means maintains equal water pressure and synchronizes the operation of the solenoids in each of the series of two or more modular units to maintain the visual integrity of the wide graphical image.

11. The apparatus of claim 7 wherein the apparatus is capable of producing pixelated falling water droplets to create a graphical image or a falling sheet of water onto which an image may be projected.

12. The apparatus of claim 7 wherein said series of two or more modular units contain a second water reservoir in parallel to said solenoids and plurality of nozzles for producing a falling sheet of water and the water management system and the control means provide a constant flow of water to said second water reservoir.

13. An apparatus for pixelating falling water droplets to create a graphical image comprising a water management system for providing, controlling and maintaining a closed-loop pressurized water supply, one or more elevated water display heads having a plurality of spaced apart nozzles arranged on a first replaceable nozzle plate in a manner to provide the intended display, each of said nozzles having a water inlet and a water outlet, and a high speed solenoid for each nozzle and a control means for controlling the water supply and for controlling the formation of the falling water droplets through each solenoid and nozzle, wherein a water reservoir is provided above the solenoids and the water inlets for said nozzles so that water pressure to the nozzles is maintained by gravity, the solenoids are connected to said nozzles to control the speed at which water exits the nozzles and whereby water droplets falling from said plurality of nozzles form a graphical image that retains its shape as it falls and wherein a second replaceable nozzle plate having a plurality of spaced apart nozzles arranged on the second replaceable nozzle plate in a manner to provide a second intended display may be interchanged into the elevated water display head for the first replaceable nozzle plate in order to provide a different display.

14. The apparatus of claim 13 wherein a vacuum line is connected to the water reservoir to prevent water leaking through the solenoids and nozzles when the water reservoir is placed under negative pressure.

15. The apparatus of claim 13 wherein each of said plurality of nozzles has an hourglass shaped passageway in cross-section from inlet to outlet orifice.

16. The apparatus of claim 15 wherein the hourglass shaped passageway is coated to provide superior flow dynamics.

17. The apparatus of claim 16 wherein the hourglass shaped passageway is coated with Carnauba or Teflon.

18. A method for pixelating falling water droplets to create a graphical image comprising providing an elevated water display head formed from a series of two or more modular units each modular unit having a plurality of spaced apart nozzles arranged on a first replaceable nozzle plate in a manner to provide the intended display, each of said nozzles having a water inlet and a water outlet, and a high speed solenoid for each nozzle and a control means for controlling the water supply and for controlling the formation of the falling water droplets through each solenoid and nozzle, wherein a water reservoir is provided above the solenoids and the water inlets for said nozzles so that water pressure to the nozzles is maintained by gravity, and the solenoids are connected to said nozzles to control the speed at which water exits the nozzles and whereby water droplets falling from said plurality of nozzles form a graphical image that retains its shape as it falls, and wherein a second replaceable nozzle plate having a plurality of spaced apart nozzles arranged on the second replaceable nozzle plate in a manner to provide a second intended display may be interchanged into the elevated water display head for the first replaceable nozzle place in order to provide a different display, and wherein a micro-controller is provided for each modular unit for a) taking incoming display data from a streaming data source and generating, by control of the solenoids, a water pixilated display of an assigned portion of the image and b) regulating the water entering the reservoir of each of the series of two or more modular units and monitoring sensors in the reservoirs to maintain optimum capacity.

19. The method of claim 18 wherein the water reservoir is placed under negative pressure to prevent water leaking through the solenoids and nozzles when the water outlet is closed.

20. The method of claim 18 wherein each of the series of two or more modular units contains a second water reservoir in parallel to said solenoids and plurality of nozzles for producing a falling sheet of water and the water management system and control means provides a constant flow of water to said second water reservoir.

* * * * *